US006758140B1

(12) United States Patent
Szumla et al.

(10) Patent No.: US 6,758,140 B1
(45) Date of Patent: Jul. 6, 2004

(54) INKJET LITHOGRAPHIC PRINTING PLATES

(75) Inventors: Thomas P. Szumla, Lockport, NY (US); David A. Niemeyer, Rochester, NY (US); Charles D. DeBoer, Palmyra, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/335,415

(22) Filed: Dec. 31, 2002

(51) Int. Cl.[7] ..... B41C 1/10

(52) U.S. Cl. ..... 101/466; 101/457; 101/462; 347/106

(58) Field of Search ..... 101/455, 457, 101/462, 463.1, 465, 466; 347/101, 102, 105, 106; 428/195

(56) References Cited

U.S. PATENT DOCUMENTS 5,804,320 A * 9/1998 Tomioka et al. ..... 428/478.2
6,020,032 A * 2/2000 Romano et al. ..... 427/411
6,050,193 A * 4/2000 DeBoer et al. ..... 101/466
6,268,101 B1 * 7/2001 Yacobucci et al. ..... 430/124
6,291,127 B1 * 9/2001 Dagan et al. ..... 430/201
6,299,302 B1 * 10/2001 DeBoer et al. ..... 428/32.24
2002/0182380 A1 * 12/2002 Nagashima et al. ..... 428/195
2003/0118789 A1 * 6/2003 Kasahara ..... 428/195

FOREIGN PATENT DOCUMENTS

GB 1419512 * 12/1975
WO WO 00/46029 * 8/2000

* cited by examiner

*Primary Examiner*—Stephen R. Funk
(74) *Attorney, Agent, or Firm*—Raymond L. Owens

(57) ABSTRACT

A method for preparing lithographic printing plates comprising coating a substrate with a mixture including colloidal silica, fumed alumina, polyethylenimine, a quaternary ammonium polymer and a hardener; utilizing an inkjet printer with pigmented inks to print a digital image on the coated substrate; and drying the image.

5 Claims, 1 Drawing Sheet

INKJET LITHOGRAPHIC PRINTING PLATES

CROSS REFERENCE TO RELATED APPLICATIONS

Reference is made to commonly assigned U.S. patent application Ser. No. 10/242,171 filed Sep. 12, 2002, entitled "Preparing Lithographic Printing Plates" by DeBoer et al, and U.S. patent application Ser. No. 10/335,383 filed Dec. 31, 2002, entitled "Digital Offset Lithographic Printing", by Thomas P. Szumla et al. the disclosures of which are incorporated herein.

TECHNICAL FIELD

This invention relates to devices and methods for the preparation of digital lithographic printing plates.

BACKGROUND OF THE INVENTION

The art of lithographic printing is based upon the immiscibility of oil and water, wherein the image area preferentially retains the oily material or ink. When a suitably prepared surface is moistened with water and ink is then applied, the background or non-image area retains the water and repels the ink while the image area accepts the ink and repels the water. The ink on the image area is then transferred to the surface of a material upon which the image is to be reproduced; such as paper, cloth and the like. Commonly the ink is transferred to an intermediate material called the blanket which in turn transfers the ink to the surface of the material upon which the image is to be reproduced.

A very widely used type of lithographic printing plate has a light-sensitive coating applied to an aluminum base. The coating may respond to light by having the portion which is exposed become soluble so that it is removed in the developing process. Such a plate is referred to as positive-working. Conversely, when that portion of the coating which is exposed becomes hardened, the plate is referred to as negative-working. In both instances the image area remaining is ink-receptive or oleophilic and the non-image area or background is water-receptive or hydrophilic. The differentiation between image and non-image areas is made in the exposure process where a film is applied to the plate with a vacuum to insure good contact. The plate is then exposed to a light source, a portion of which is composed of UV radiation. In the instance where a positive plate is used, the area on the film that corresponds to the image on the plate is opaque so that no light will strike the plate, whereas the area on the film that corresponds to the non-image area is clear and permits the transmission of light to the coating which then becomes more soluble and is removed. In the case of a negative plate the converse is true. The area on the film corresponding to the image area is clear while the non-image area is opaque. The coating under the clear area of film is hardened by the action of light while the area not struck by light is removed. The light-hardened surface of a negative plate is therefore oleophilic and will accept ink while the non-image area which has had the coating removed through the action of a developer is desensitized and is therefore hydrophilic.

Direct write photothermal litho plates are known as the Kodak Direct Image Thermal Printing Plate manufactured by Kodak Polychrome Graphics. However, they require wet processing in alkaline solutions. It would be desirable to have a direct write litho plates that did not require any processing, The prior art has tried to produce such plates by a variety of means. All of them fall short of a plate that has high writing sensitivity, high image quality, short roll up, and long run length without any processing.

U.S. Pat. No. 5,372,907 describes a direct write litho plate which is exposed to a laser beam, then heated to crosslink and thereby prevent the development of the exposed areas and to simultaneously render the unexposed areas more developable. The plate is then developed in conventional alkaline plate developer solution. The problem with this is that developer solutions and the equipment that contains them require maintenance, cleaning, and periodic developer replenishment, all of which are costly and cumbersome.

U.S. Pat. No. 4,034,183 describes a direct write litho plate without development whereby a laser absorbing hydrophilic top layer coated on a base is exposed to a laser beam to burn the absorber to convert it from an ink repelling to an ink receiving state. All of the examples and teachings require a high power laser, and the run lengths of the resulting litho plates are limited.

U.S. Pat. No. 3,832,948 describes both a printing plate with a hydrophilic layer that may be ablated by strong light from a hydrophobic base and also a printing plate with a hydrophobic layer that may be ablated from a hydrophilic base. However, no examples are given.

U.S. Pat. No. 3,964,389 describes a no process printing plate made by laser transfer of material from a carrier film (donor) to a lithographic surface. The problem of this method is that small particles of dust trapped between the two layers may cause image degradation. Also, two sheets to prepare is more expensive.

U.S. Pat. No. 4,054,094 describes a process for making a litho plate by using a laser beam to etch away a thin top coating of polysilicic acid on a polyester base, thereby rendering the exposed areas receptive to ink. No details of run length or print quality are giving, but it is expected that an uncrosslinked polymer such as polysilicic acid will wear off relatively rapidly and give a short run length of acceptable prints.

U.S. Pat. No. 4,081,572 describes a method for preparing a printing master on a substrate by coating the substrate with a hydrophilic polyamic acid and then imagewise converting the polyamic acid to melanophilic, polyimide with heat from a flash lamp or a laser. No details of run length, image quality or ink/water balance are given.

U.S. Pat. No. 4,731,317 describes a method for making a litho plate by coating a polymeric diazo resin on a grained anodized aluminum litho base, exposing the image areas with a yttrium aluminum garnet (YAG) laser, and then processing the plate with a graphic arts lacquer. The lacquering step is inconvenient and expensive.

Japanese Kokai No. 55/105560 describes a method of preparation of a litho plate by laser beam removal of a hydrophilic layer coated on an oleophilic base, in which a hydrophilic layer contains colloidal silica, colloidal alumina, a carboxylic acid, or a salt of a carboxylic acid. The only examples given use colloidal alumina alone, or zinc acetate alone, with no crosslinkers or addenda. No details are given for the ink/water balance or limiting run length.

WO 92/09934 describes and broadly claim any photosensitive composition containing a photoacid generator and a polymer with acid labile tetrahydropyranyl groups. This would include a hydrophobic/hydrophilic switching lithographic plate composition. However, such a polymeric switch is known to give weak discrimination between ink and water in the printing process.

EP 0 562 952 A1 describes a printing plate having a polymeric azide coated on a lithographic base and removal of the polymeric azide by exposure to a laser beam. No printing press examples are given.

U.S. Pat. No. 5,460,918 describes a thermal transfer process for preparing a litho plate from a donor with an oxazoline polymer to a silicate surface receiver. A two sheet system such as this is subject to image quality problems from dust and the expense of preparing two sheets.

European Patent Publication No. 503,621 discloses a direct lithographic plate making method which includes jetting a photocuring ink onto the plate substrate, and exposing the plate to UV radiation to harden the image area. An oil-based ink may then be adhered to the image area for printing onto a printing medium. However, there is no disclosure of the resolution of ink drops jetted onto the substrate, or the durability of the lithographic printing plate with respect to printing runlength.

Canadian Patent No. 2,107,980 discloses an aqueous ink composition which includes a first polymer containing a cyclic anhydride or derivative thereof and a second polymer that contains hydroxyl sites. The two polymers are thermally crosslinked in a baking step after imaging of a substrate. The resulting matrix is said to be resistant to an acidic fountain solution of an offset printing process. The Examples illustrate production of imaged plates said to be capable of lithographic runlengths of from 35,000 to 65,000 copies, while a non-crosslinked imaged plate exhibited a runlength of only 4,000 copies. The baking process is inconvenient.

U.S. Pat. No. 5,364,702 discloses an ink-jet recording layer supported on a substrate, with the ink receiving layer containing at least one of acetylene glycol, ethylene oxide addition product and acetylene glycol and acetylene alcohol, each of which have a triple bond in its molecule. The ink receiving layer may also contain an inorganic pigment such as silica, a water-soluble polymeric binder, and a cationic oligomer or polymer. No discussion of porosity is provided.

U.S. Pat. No. 5,820,932 discloses a process for the production of lithographic printing plates. Ink jet liquid droplets form an image upon the surface of a printing plate corresponding to digital information depicting the image as provided by a computer system which is in communication with the printer heads. The droplets from the printer head comprise resin forming reactants which polymerize on the plate surface, alone or in combination with reactant precoated on the plate, to form a printable hard resin image. The resin image so formed provides a lithographic printing plate useful for extended print runs.

All of the above listed methods for preparing lithographic printing plates by printing the image with an inkjet printer require the use of a special ink or fluid in the inkjet printer.

It would be desirable to have a way to prepare lithographic printing plates easily and cheaply from a digital image file stored on a computer, utilizing a commercially available inkjet printer with commercially available inkjet inks.

SUMMARY OF THE INVENTION

It is an object of this invention to prepare lithographic printing plates easily and inexpensively from a digital image file stored on a computer, utilizing a commercially available inkjet printer with commercially available inkjet inks.

It is another object of this invention to provide a means of preparing a lithographic printing plate utilizing an inkjet printer.

It is another object of this invention to provide a means of preparing a lithographic printing plate cheaply and economically.

It is another object of this invention to provide a means of preparing a lithographic printing plate producing high quality press impressions.

These objects are achieved by coating a substrate with a mixture including colloidal silica, fumed alumina, polyethylenimine, a quaternary ammonium polymer and a hardener and utilizing an inkjet printer with pigmented inks to print a digital image on said coated substrate and drying the image.

An advantage of this invention is that the printing plates can be prepared from digital sources with minimal cost and difficulty.

Another advantage of this invention is that the printing plates can be prepared utilizing commercially available inkjet printers with commercially available inkjet inks.

DETAILED DESCRIPTION OF THE INVENTION

Figure 1:
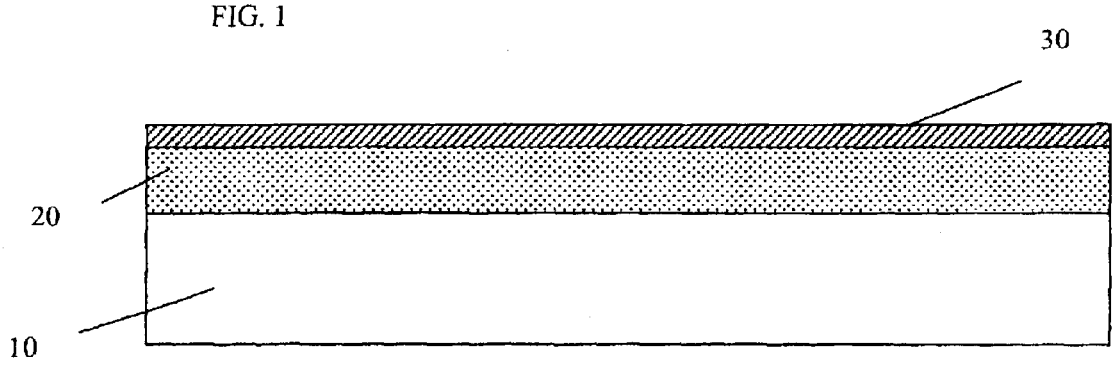
FIG. 1 shows a side view of the printing plate according to this invention.

FIG. 1 shows a side view of the printing plate according to this invention. A substrate 10 is shown with an adsorptive overcoat 20 including a mixture of colloidal silica, alumina, a polymeric amine, a quaternary ammonium polymer, and a hardener.

In one embodiment of the invention, a protective layer 30 which prevents accidental deposition of oleophilic materials such as fingerprints is coated over the adsorptive overcoat 20.

The substrate 10 can be mechanically or electrochemically grained aluminum. Graining aluminum to prepare a printing plate substrate is well known to those skilled in the art of lithography. The grained surface has an average roughness on the order of a few microns. The rough surface has an increased ability to carry water and thus repel lithographic ink in the offset printing process. In this invention, the water carrying layer is coated over the grained aluminum. The function of the graining process is to provide a physical anchor for the overcoat, and to promote adhesion between the substrate and the adsorptive overcoat 20. In addition, some of the roughness of the graining is carried through to the surface of the top layer. This roughness improves the ability of the plate to carry water in the offset printing process. Other materials such as polyethyleneterphthalate or steel can also be used for the substrate 10.

The adsorptive overcoat 20 includes a mixture containing colloidal silica, alumina, a polymeric amine, a quaternary ammonium polymer, and a hardening agent, coated out of water. The mixture may also contain a mineral acid such as sulfuric or phosphoric acid to neutralize and solubilize the polymeric amine. The mixture may also contain surfactants to improve spreading and uniformity of the coating. Other materials may be added to the mixture for cosmetic purposes, such as colorants of various kinds such as dyes or pigments.

In a preferred embodiment of the invention, the adsorptive overcoat 20 is coated from the following aqueous mixture:

5.1% fumed alumina (DeGussa Oxide C)

5.9% colloidal silica (DuPont LUDOX CL)

1.17% polyethylenimine (BASF LUPASOL SK)

0.25% guaternized solution of Poly[bis(2-chloroethyl) ether-alt-1,3-bis[3-(dimethylamino)propyl]urea]

(Aldrich Chemical Company, #45,862-7)

0.46% phosphoric acid 0.01% formaldehyde 0.005% Olin 10G surfactant.

Coating the mixture onto the grained aluminum substrate 10 is conveniently done with a wire wound rod, as is well known to those skilled in the art. Other methods of coating can also be used, including extrusion hopper coating, roller coating and spray coating.

The amount of silica in the coating mixture may vary from about 2 percent to about 15 percent, more preferably from about 5 percent to about 7 percent. The amount of alumina in the coating mixture may vary from about 1 percent to about 15 percent, more preferably from about 4 percent to about 6 percent. The amount of polymeric amine in the coating mixture may vary from about 0.1 percent to about 2 percent, more preferably from about 0.7 percent to about 1.4 percent. The kind of silica used in the coating mixture is preferably one that is compatible with a polymeric amine. It has been found that acidic colloidal silica, such as LUDOX CL from the DuPont Company, Wilmington, Del. is compatible with polymeric amines. The polymeric amine may be a linear or branched polymer where the amine is part of the polymer backbone chain, such as polyethylenimine, or can be a polymer where the amine is an appendage from the polymer backbone, such as polyvinybenzylamine or polyallylamine. Most preferably, the amine is a primary or secondary amine. Least preferred are aromatic amines. The polymeric amine may be neutralized with an equivalent amount of mineral acid such as hydrochloric or sulfuric acid before being mixed with the colloidal silica. The alumina used in the coating mixture is preferably a fine particle alumina such as DeGussa Oxide-C fumed alumina. The hardener, if used, is added to the mixture in an amount equal to about 1% to about 3% of the polymeric amine. Coating surfactants are used in amount equal to about 0.001% to about 1% of the total weight of the solution. The wet thickness of the coated layer may vary from about 1 micron to about 100 microns, more preferably from about 10 microns to 40 microns. The coating is air dried, with or without warming, to give the adsorptive overcoat 20.

The protective layer 30 has been described in U.S. Pat. Nos. 6,050,193 and 6,044,762 hereby incorporated by reference. Materials used for the protective layer 30 include gum arabic, algin, carrageenan, fucoidan, laminaran, corn hull gum, gelatin, gum ghatti, karaya gum, locust bean gum, pectin, a dextran, agar, guar gum, hydroxypropylcellulose, hydroxyethylcellulose, hydroxypropylmethylcellulose, carboxymethylcellulose, polyvinyl alcohol, a polyacrylamide, polyethylenimine or polyvinylpyrrolidone. In a preferred embodiment of the invention, the protective layer 30 is gum Arabic (acacia gum). The preferred thickness of the protective layer 30 is from about 0.5 microns to about 5 microns, and more preferably from about 1 micron to about 2 microns. The protective layer 30 can be coated from water, preferably with a wet coating thickness of from about 10 microns to about 40 microns. The coating is then air dried, with or without heat, to produce the protective layer 30.

Figure 2:
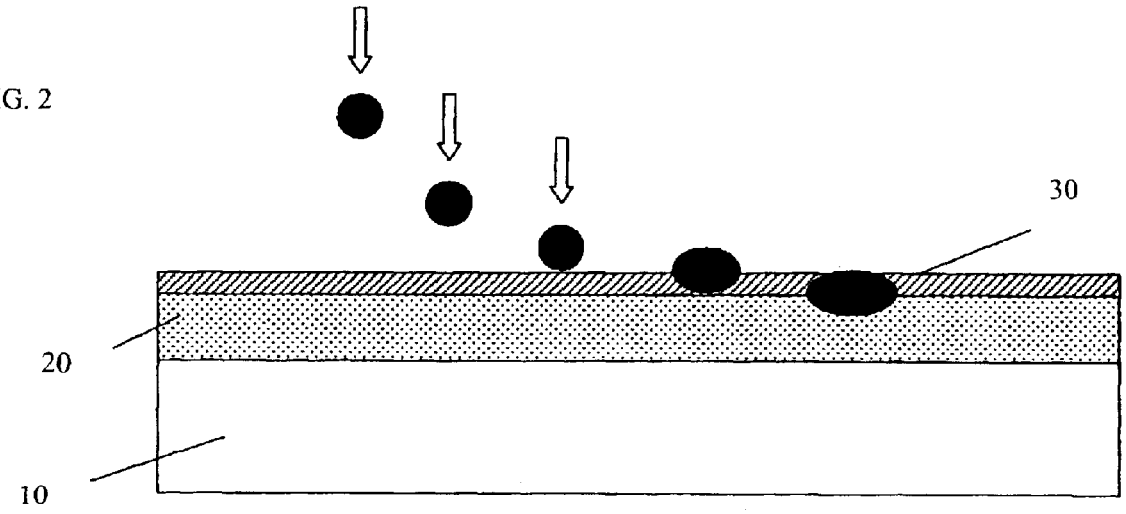
FIG. 2 shows the digital inkjet image being applied to the printing plate as a series of droplets of inkjet pigmented ink impinging on and being absorbed by the plate.

FIG. 2 shows the imaging process for the lithographic printing plate. Drops of inkjet pigmented ink are shown as black circles moving in the direction of the arrows. The ink drops are emitted from an inkjet print head (not shown). As shown in FIG. 2, as the drops encounter the plate, the drops are adsorbed into the layers, and dry to form an image pixel that is attractive to lithographic printing ink, while the background holds water or fountain solution on the printing press and repels lithographic printing ink. It has been found that all the pigment based inkjet inks that have been tried will form an image that will attract or accept lithographic printing ink on a press. In contrast, the commonly used dye based inkjet inks will not form an image that will attract or accept lithographic printing ink on a press. Pigment based inkjet inks are commonly made by grinding a pigment in water with a polymeric dispersing agent, as is well known to those skilled in the art. Further, it has been found that a solution of a polymeric dispersing agent, without added pigment, will also function in this invention to form an image that will attract or accept lithographic printing ink on a press. It appears that the polymeric dispersing agent is the active material in forming an image on the printing plate of this invention, and that the pigment just goes along for the ride. Nonetheless, the pigment serves a valuable function in this invention, because it makes the image visible, so that the press operator can judge the quality and position of the image when mounting the plate on the press. The pigment may also contribute to the ability of the imaged areas of the plate to hold lithographic ink.

The following example will illustrate the practice of the invention.

EXAMPLE 50 g of fumed alumina (DeGussa Oxide C) was mixed with 655 g of water by shaking. Then 193 g of LUDOX CL (DuPont), a cationic aqueous dispersion of colloidal silica mixed with an oxide of alumina and silica, was added and mixed. Then 23 g of LUPASOL SK (24% polyethylenimine, from BASF), an aqueous solution of a high molecular weight (~2 million daltons) of a polyethyleneimine, and 23 g of 2M phosphoric acid are added to the alumina-silica mixture. Then 10 g of 15% Poly[bis(2-chloroethyl) ether-alt-1,3-bis[3-(dimethylamino)propyl]urea], quaternized solution (Aldrich Chemical Company, #45,862-7) in water were added, and the mixture was tumbled with 1.8 mm zirconia beads for 3 to 7 days. (The tumbling rate starts off slowly, because the mixture was viscous. After 24 hours the tumbling rate can be increased as the viscosity drops.) The mixture was coated on a grained, anodized aluminum support with a 25 micron Meyer Rod and allowed to dry. The plate was then placed in the paper feed tray of an Epson Stylus C80 Inkjet Printer equipped with Epson C80 Durabright Inks. An image was printed onto the plate and allowed to dry. The plate was then mounted on an AB Dick press and 20,000 high quality impressions were made.

The invention has been described in detail, with particular reference to certain preferred embodiments thereof, but it should be understood that variations and modifications can be effected with the spirit and scope of the invention.

PARTS LIST

10 substrate

20 adsorptive overcoat

30 protective layer

What is claimed is:

1. A method for preparing lithographic printing plates comprising:

(a) coating a substrate with a mixture including colloidal silica, fumed alumina, polyethylenimine, a quaternary ammonium polymer and a hardener;

(b) utilizing an inkjet printer with pigmented inks to print a digital image on said coated substrate; and (c) drying the image.

2. The method of claim 1 wherein the plate is overcoated with a protective water soluble polymer having a contact angle of greater than 20 degrees with a drop of pigmented inkjet ink.

3. The method of claim 1 where the dry thickness of the coated layer is greater than 1 micron and less than 10 microns.

4. The method of claim 1 where the hardener is formaldehyde.

5. The method of claim 1 wherein the quaternary ammonium polymer is a quaternized solution of Poly[bis(2-chloroethyl) ether-alt-1,3-bis[3-(dimethylamino)propyl] urea].

* * * * *